US006648304B1

(12) United States Patent
Zhu

(10) Patent No.: US 6,648,304 B1
(45) Date of Patent: Nov. 18, 2003

(54) MODULAR FENCE

(75) Inventor: Alan Qing Zhu, Alta Loma, CA (US)

(73) Assignee: XCEL Distribution, Inc., La Verne, CA (US)

( * ) Notice: Subject to any disclaimer, the term of this patent is extended or adjusted under 35 U.S.C. 154(b) by 0 days.

(21) Appl. No.: 10/087,258

(22) Filed: Mar. 1, 2002

(51) Int. Cl.[7] ..... E04H 17/00

(52) U.S. Cl. ..... 256/22; 256/59; 256/65.01; 256/65.03; 256/65.08

(58) Field of Search ..... 256/22, 59, 65.01, 256/65.03, 65.04, 65.11, 65.12, 21, 24, 65.07, 65.08, 34, 72; 403/230, 231

(56) References Cited

U.S. PATENT DOCUMENTS 1,664,080 A * 3/1928 Mapson ..... 256/22
3,067,985 A * 12/1962 Cusack ..... 256/22
5,150,885 A 9/1992 Leone
5,443,244 A * 8/1995 Gibbs ..... 256/22
5,882,001 A 3/1999 Reinbold
6,053,481 A 4/2000 Scheide

* cited by examiner

*Primary Examiner*—Lynne H. Browne
*Assistant Examiner*—Victor MacArthur
(74) *Attorney, Agent, or Firm*—Thomas I. Rozsa; Tony D. Chen

(57) ABSTRACT

A modular fence assembly including a pair of vertical posts positioned at suitable distance and adapted to be secured to a suitable support surface. At least one horizontal upper and lower rails extend between and secured to the vertical posts. The horizontal upper rail has a plurality of vertical apertures which are substantially aligned with a plurality of vertical apertures on the horizontal lower rail. A plurality of pickets are respectively inserted through the vertical apertures of the upper rail and through aligned vertical apertures of the lower rail. Each picket has at least two transverse locking slotted apertures for respectively receiving a H-shaped locking clip to secure the picket to the rail and preventing vertical movement of the pickets with respect to the rails.

9 Claims, 6 Drawing Sheets

MODULAR FENCE

BACKGROUND OF THE INVENTION

1. Field of the Invention

The present invention relates generally to the field of fences. More particularly, the present invention relates to the field of modular picket fences.

2. Description of the Prior Art

Specifically, prior art wrought iron fences are well known in the art. These prior art wrought iron fences have become especially popular in recent years as protective fencing around swimming pools, gardens and serve as security barriers around patios and entryways. The wrought iron fences are formed from rods or tubes of metal which are welded to upper and lower rails to form panels or sections. The panels are either welded between upright metal posts or bolted to the upright posts. The iron fences are sturdy but have a number of problems such as the welded areas are susceptible to rusting even when painted and if galvanized components are used the welding destroys the coating at the welded area that leads to rust. The wrought iron fences are usually assembled and joined together at the job site and required considerable skill and time on the part of the professional artisans. For this reason, they are relatively expensive.

The following three (3) prior art patents are found to be pertinent to the field of the present invention:

1. U.S. Pat. No. 5,150,885 issued to Leone on Sep. 29, 1992 for "Picket Fence Assembly" (hereafter the "Leone");
2. U.S. Pat. No. 5,882,001 issued to Reinbold on Mar. 16, 1999 for "Modular Fence Structure" (hereafter the "Reinbold"); and
3. U.S. Pat. No. 6,053,481 issued to Scheide on Apr. 25, 2000 for "Security Fence Rail Bracket" (hereafter the "Scheide").

Leone discloses a picket fence assembly which comprises an upper rail, a lower rail and a plurality of vertically disposed pickets. Each rail has a plurality of non-circular apertures that extend therethrough in substantial vertical alignment. Each picket extends through one of the apertures in the upper rail and through one of the aligned apertures in the lower rail. The pickets have upper and lower indentations for engaging the upper and lower rails. The pickets are respectively held in the apertures and are axially movable in the apertures to a locking position at which the indentations in the pickets are engaged by the rails and axial movement of the pickets relative to the rails is prevented. The rails are provided with a frictional locking means, such that the pickets are engaged in a frictional fit therewith in the locking position wherein rotational movement of the pickets is restrained. The frictional locking means comprises a plurality of paired opposed indentations in the flanges of the rails. The indentations conform with the perimeter configuration of the pickets in the locking position.

Reinbold discloses a modular fence structure which includes a plurality of posts having vertically spaced ribs on confronting surfaces for supporting the respective end portion of inverted U-shaped rails. The rails have a plurality of longitudinally equally spaced vertically aligned apertures with each aperture having a tab portion of the U-shaped rail bight portion projecting into the aperture. A plurality of pickets are cooperatively received by the respective aligned apertures with each picket having a pair of transverse longitudinally spaced slots in its wall cooperatively nesting a respective tab projecting into each slot. An inverted L-shaped spring clip enters the respective aperture on that side of the post opposite its slot to engage upper and lower surfaces of the bight portion of the respective rail adjacent the aperture and lock the respective picket against movement relative to the rails.

Scheide discloses a security fence rail bracket for supporting a fence rail which includes a hollow body with an open-topped cavity and an end wall with a cross-shaped aperture through which a bolt is passed into a fence post. The angularity of the body with respect to the post surface is adjusted by installing one or more tapered spacers between the body and the post. The spacers have nesting bosses and recesses, and offset slots through which the bolt passes.

It is desirable to provide a modular picket fence which may be formed from metal or other materials and easily and conveniently assembled on the job site by a professional or homeowner. It is also desirable to provide a modular picket fence which includes separate interconnecting modular parts that do not require any welding but a method of assembling them together in a less expensive way, thereby reducing costs and lowing assembled labor.

SUMMARY OF THE INVENTION

The present invention is a unique modular picket fence.

The modular picket fence comprises a pair of vertical posts positioned at suitable distance and adapted to be secured to a suitable support surface. At least one horizontal upper and lower rails extend between and secured to the vertical posts. The horizontal upper rail has a plurality of vertical apertures which are substantially aligned with a plurality of vertical apertures on the horizontal lower rail. A plurality of vertical pickets are respectively inserted through the vertical apertures of the upper rail and through aligned vertical apertures of the lower rail. Each picket has at least two transverse locking slotted apertures for respectively receiving a H-shaped locking clip to secure the picket to the rail.

It is an object of the present invention to provide a modular picket fence which has a decorative and functional enclosure for any physical area formed from modular components permitting a complete customized fencing section which may be erected at the installation site, preferably from prefabricated metallic material.

It is an additional object of the present invention to provide a modular picket fence in the form that may be readily assembled from a set of modular components by a person or homeowner of ordinary skill and experience without the use of welding equipment or other special tools.

It is a further object of the present invention to provide a modular picket fence which the manufactured components are reduced to a small number of very simple and inexpensive components.

It is a further object of the present invention to provide a modular picket fence which includes an insertable locking means that engages the picket and rail for precluding vertical movement of the pickets with respect to the rails.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 6:
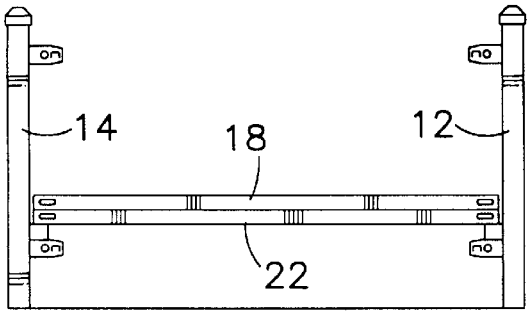
FIGS. 6*a* through 6*e* illustrates how the modular picket fence is assembled in accordance with the present invention.
FIG. 6*f* is a side elevational view of another arrangement of the modular picket fence in accordance with the present invention.
FIG. 6*g* is a side elevational view of a further arrangement of the modular picket fence in accordance with the present invention.
Figure 6:
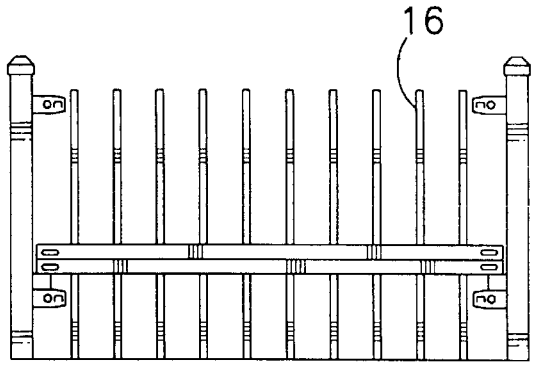
Figure 6:
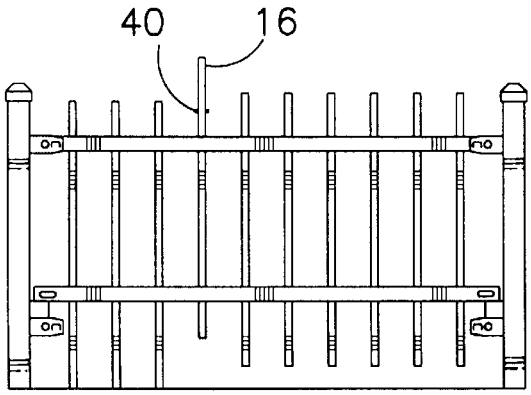
Figure 6:
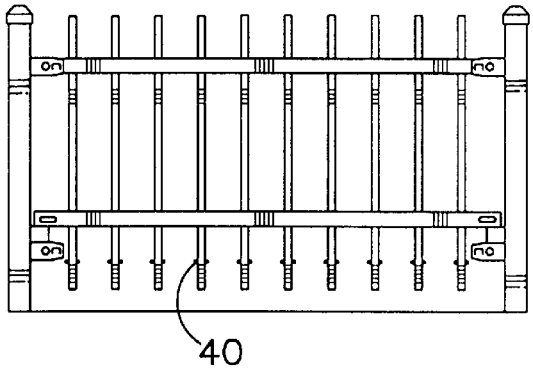
Figure 6:
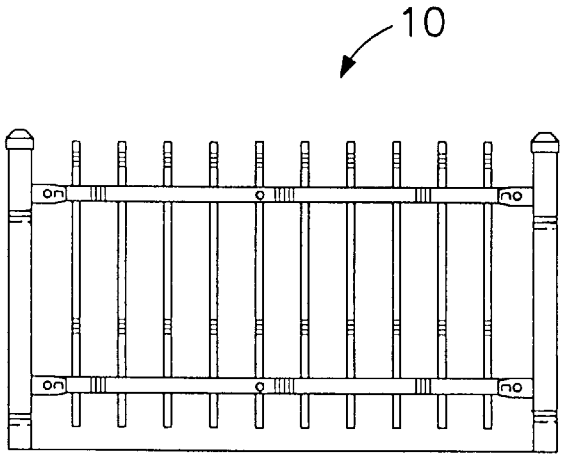
Figure 6:
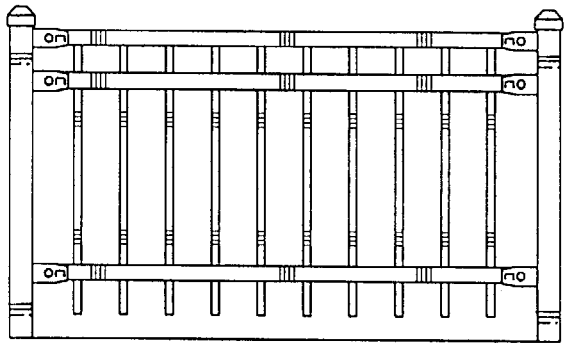
Figure 6:
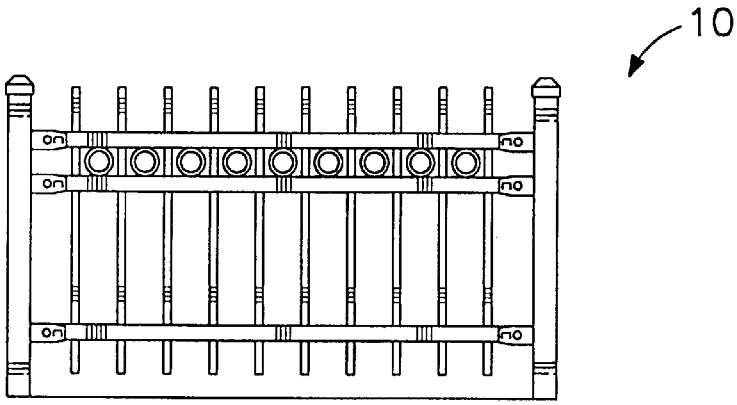

Described briefly, the present invention is a modular picket fence. In the first arrangement of the present invention, the modular picket fence may be assembled with a pair of horizontal upper rails and one horizontal lower rail as shown in FIGS. 1, 2, 6*f*, and 6*g*. In the second arrangement of the present invention, the modular picket fence may be assembled with at least one horizontal upper rail and at least one horizontal lower rail as shown in FIGS. 6(*a*)–6(*e*).

Figure 1:
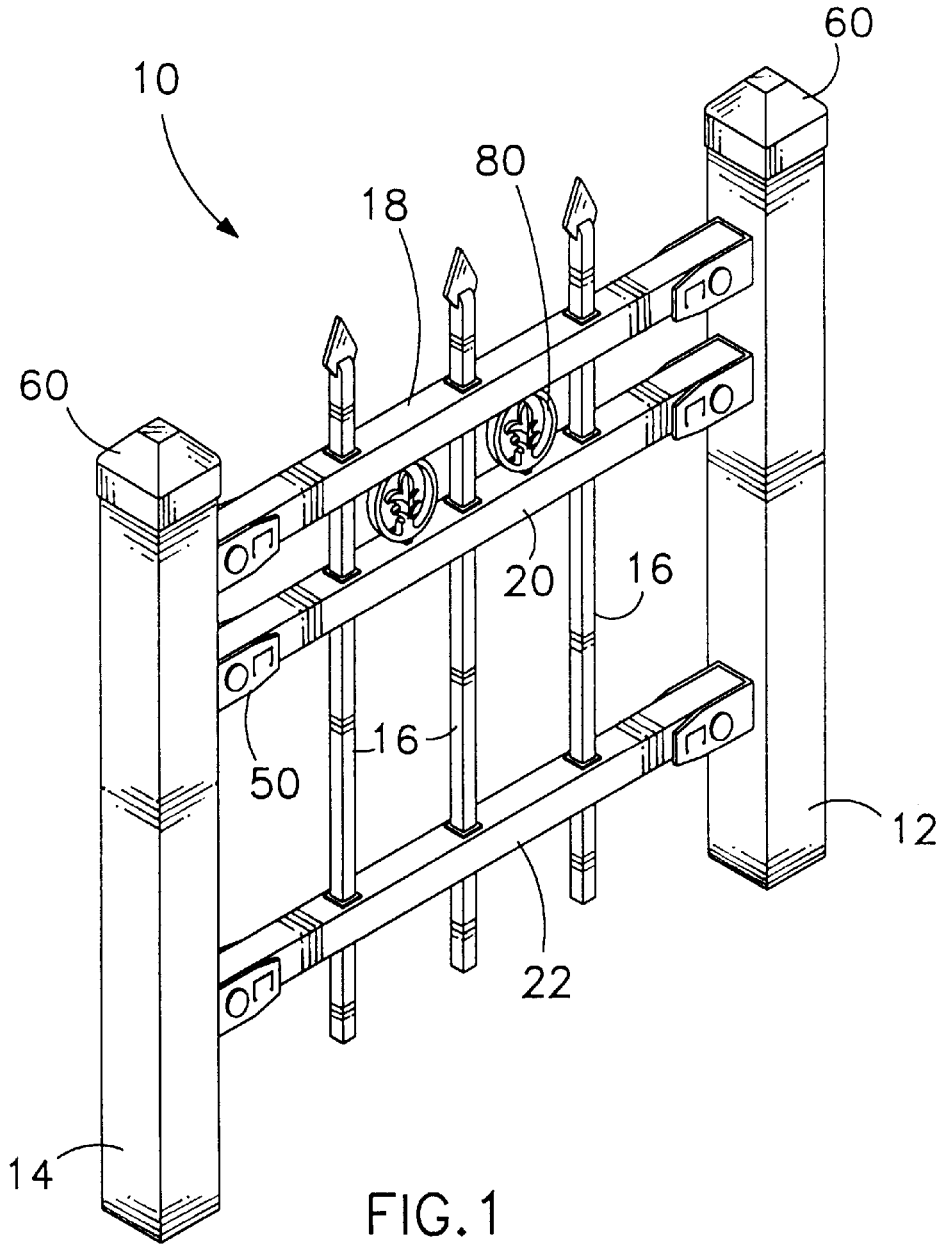
FIG. 1 is a perspective view of the preferred embodiment of a fully assembled modular picket fence in accordance with the present invention.

Referring to FIG. 1, there is shown at 10 a first arrangement of the present invention modular picket fence which comprises a pair of hollow vertical posts or columns 12 and 14 usually spaced apart approximately 6–8 feet and positioned to be secured to a support surface or any other suitable surface, a plurality of hollow vertically disposed pickets or poles 16, a pair of spaced apart elongated hollow horizontal upper rails 18 and 20, and an elongated hollow horizontal lower rail 22. In the example shown, the posts 12 and 14 are square shaped tubular but obviously may be of other cross-sectional configuration as desired.

For clarity purposes, only three vertical pickets 16 are illustrated. It will be appreciated that the vertical pickets 16 are not limited to the number of pickets illustrated in FIG. 1. It is emphasized that while the three vertical pickets are depicted, it is also within the spirit and scope of the present invention to have a plurality of vertical pickets which can be used as shown in FIGS. 6*b*–6*g*. It will also be appreciated that at least one elongated horizontal upper rail 18 and at least one elongated horizontal lower rail 22 can be used with the present invention modular fence assembly as shown in FIGS. 6(*a*)–6(*e*).

Figure 2:
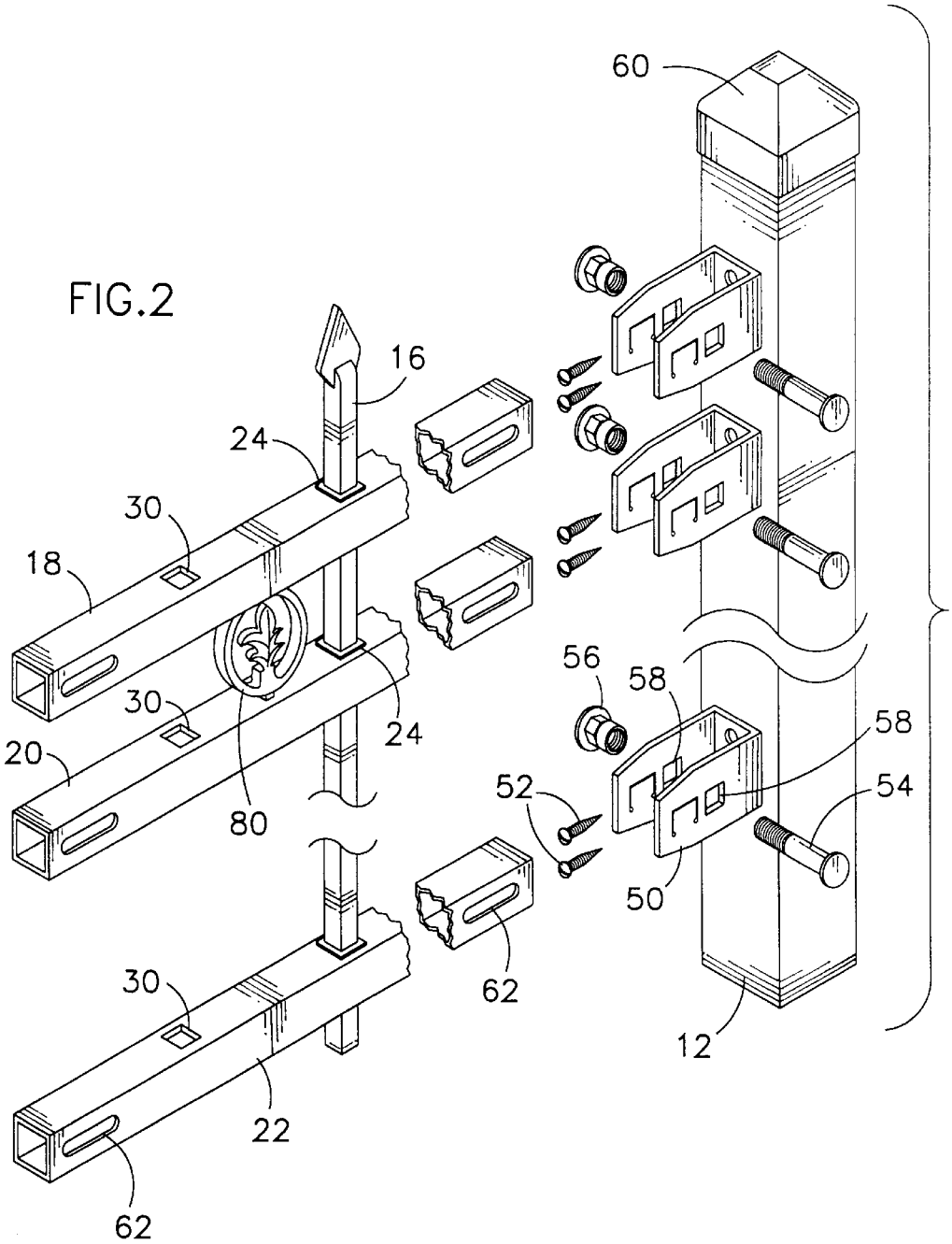
FIG. 2 is an enlarged exploded perspective view of the present invention modular picket fence shown in FIG. 1.

Referring to FIGS. 1 and 2, each of the vertical posts 12 and 14 are substantially identical, and to the extent they are, only one will be described in detail in the interest of brevity. At least three U-shaped metal brackets 50 are attached to the post 12 and located at three different locations along the length of the post 12, where the brackets 50 of each post face each other as shown in FIG. 1. Each bracket 50 is held against the inner wall or surface of the post 12 by at least two screws fasteners 52 which are threadedly engaged to the bracket 50 and the post 12. As depicted in FIG. 2, the ends of the rails 18, 20 and 22 are removably attached between the posts 12 and 14 by the U-shaped metal brackets 50, which receive and retain the rails thereto by using bolts 54 and nuts 56. Each bolt 54 is inserted through the hole 58 on one side of the bracket 50 and then inserted through a slotted adjustment aperture 62 of the rail for allowing a horizontal adjustment of the rails. An ornamental cover or cap 60 is inserted in the upper end of the vertical post 12 for decorative and sealing purposes.

Each of the horizontal rails 18, 20 and 22 are substantially identical, and to the extend they are, only one will be described in detail in the interest of brevity. The rail 18 has a plurality of longitudinally equally spaced apart vertically aligned non-circular apertures 30, preferably four-sided apertures for receiving the plurality of non-circular pickets 16, preferably four-sided pickets. The non-circular apertures 30 are being of shape and size equal to the cross sectional shape and size of the pickets 16 such that the pickets 16 may be inserted therethrough. The rail 18 also has two slotted apertures 62 extending through the side of rail and located at opposite ends.

Figure 5A:
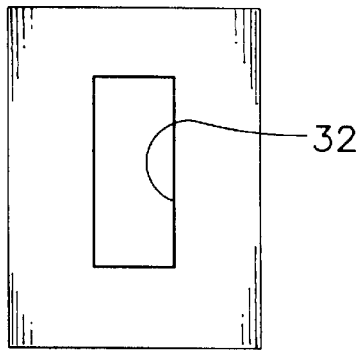
FIG. 5*a* is a plan view of a preferred embodiment of a locking slotted aperture in accordance with the present invention.

As shown in FIGS. 1 and 2, there are provided ornamental caps 24 for each aperture 30 on the rails 18, 20 and 22, and which is slidable on the picket 16 to position the ornamental cap 24 for covering and sealing the aperture 30 when the pickets 16 are in a locking position. The pickets 16 have a uniform square cross-section and have at least one transverse upper locking slotted aperture 32 and at least one transverse lower locking slotted aperture 34 extending therethrough (see FIG. 3) and located along the length of the picket 16 and cooperating with the rails 18 and 22 for precluding movement of the pickets 16 with respect to the rails 18, 20 and 22. The upper and lower locking slotted apertures 32 and 34 are generally rectangular shape as shown in FIG. 5*a*. Each picket 16 is held in position by at least two H-shaped locking clips or means 40 (see FIG. 3).

Figure 5B:
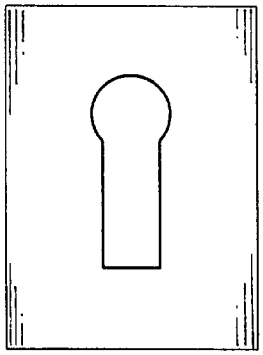
FIG. 5*b* is a plan view of an alternative embodiment of a locking slotted aperture in accordance with the present invention.
Figure 5C:
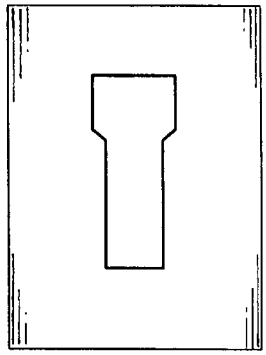
FIG. 5*c* is a plan view of still another alternative embodiment of a locking slotted aperture in accordance with the present invention.

It will be appreciated that the upper and lower locking slotted apertures 32 and 34 are not limited to the rectangular shape illustrated in FIG. 5*a*. It is emphasized that while the rectangular shape of the locking slotted aperture is preferred, it is also within the spirit and scope of the present invention to have a plurality of different shapes for the locking slotted apertures as shown in FIGS. 5*b* and 5*c*.

Figure 3:
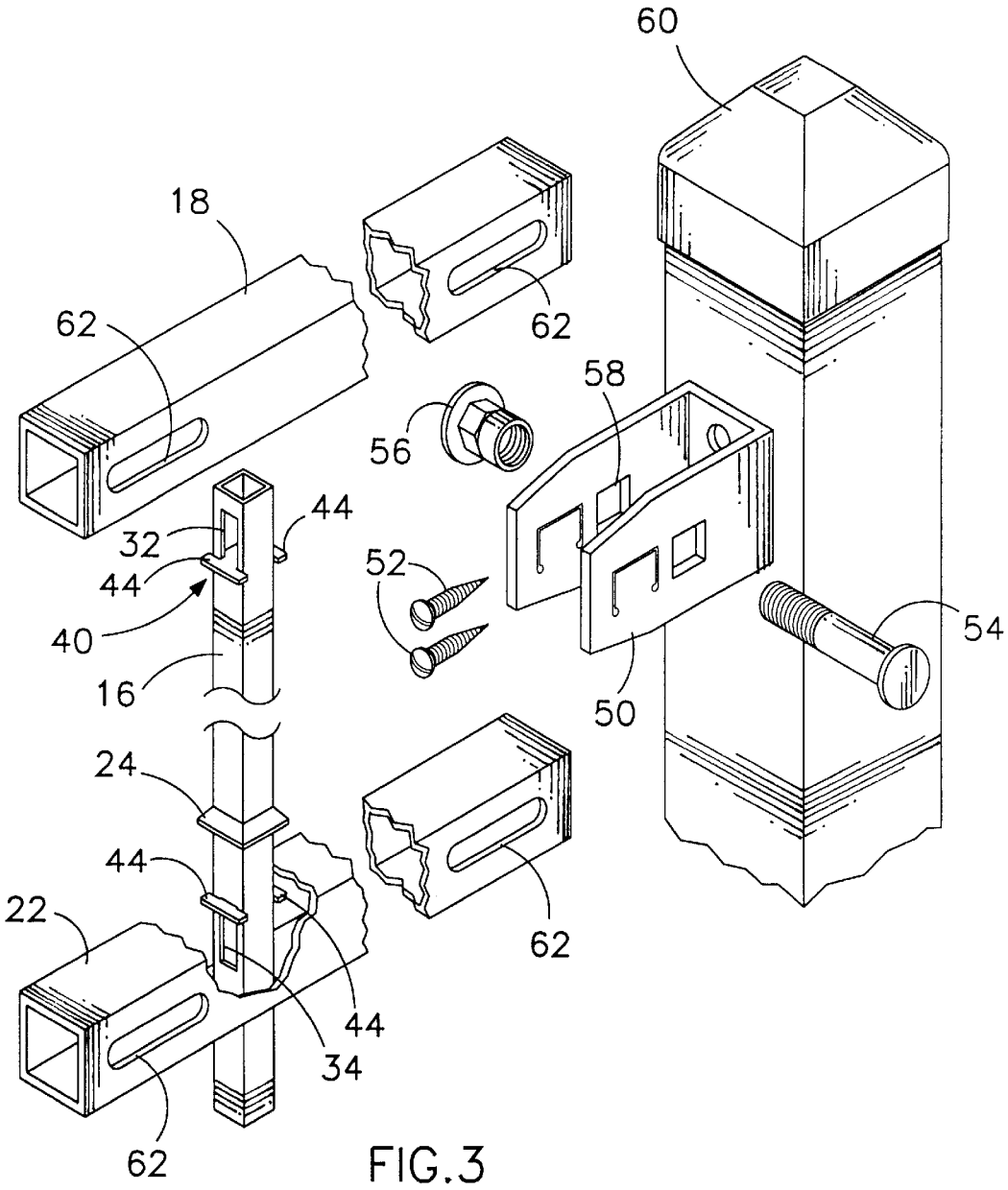
FIG. 3 is a partial enlarged exploded perspective view of an alternative embodiment of the present invention modular picket fence.
Figure 4:
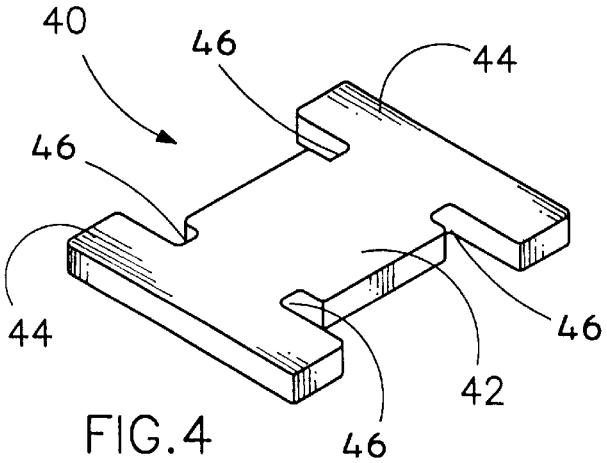
FIG. 4 is an enlarged perspective view of one of the plurality of H-shaped locking clips in accordance with the present invention.

Referring to FIGS. 3 and 4, there is shown the H-shaped locking clip or means 40 that includes a middle section 42 and two leg sections 44 which are formed at opposite ends of the middle section 42. The middle section 42 and the two leg sections 44 form four separate recesses 46 at locations where the middle section 42 and the two leg sections 44 are connected together. The H-shaped locking clip 40 is installed by having one of the leg sections 44 inserted into the locking slotted aperture, where the middle section 42 is concealed within the locking slotted aperture and the two leg sections are outside of the slotted aperture as shown in FIG. 3.

Referring to FIGS. 6*a*–6*e*, in order to assemble the modular fence 10, the two vertical posts 12 and 14 are positioned at remote locations, where the brackets 50 of each post face each other as shown in FIG. 6*a*. The pickets 16 are respectively inserted through the apertures 30 in the upper rail 18 and then inserted through the apertures 30 in the lower rail 22 as shown in FIG. 6*b*. The pickets 16 are thereby in the assembly position as shown. The ends of the upper rail 18 are then attached to the bracket 50 of each post as shown. Each H-shaped locking clip 40 is respectively inserted into each upper and lower locking slotted apertures 32 and 34 of each picket 16 as shown in FIGS. 6*c* and 6*d*, where the middle section 42 is located within the slotted locking aperture while the leg sections 44 are located external to the picket 16 as shown in FIG. 3. The upper H-shaped locking clips 40 engage against the upper surface or wall of the upper rail 18 (see FIG. 6*c*) while the lower H-shaped locking clips 40 engage against the lower surface or wall of the lower rail 22. The ends of the. lower rail 22 are then attached to the bracket 50 of each post to provide a finish product as shown in FIG. 6*e*.

In the locking position, the H-shaped locking clips 40 frictionally abut the exterior walls of the rails, thereby preventing vertical displacement of the pickets 16. Once the pickets 16 are in the locking position, ornamental caps 24 are pushed downwardly such that the ornamental caps 24 are respectively inserted into the apertures 30 to form a tight smooth joint between picket and rail, thereby further preventing picket displacement, and preventing erosion of the joint through environmental wear and tear. Each picket is inserted and locked into place in the same manner.

The present invention may further include ornaments 80 which can be used with the first arrangement of the present invention. These ornaments 80 are attached to and between the pair of horizontal upper rails 18 and 20 as shown in FIGS. 1, 2 and 6*g* for decorative purposes.

Referring to FIG. 6*f*, in this arrangement of the present invention, the modular picket fence is assembled as shown in FIG. 3.

The modular fence further includes bolts and nuts, where each bolt is inserted through a respective horizontal rail and picket for further securing the pickets to the rails.

The present invention conforms to conventional forms of manufacture or any other conventional way known to one skilled in the art.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A modular fence assembly, comprising:

a. a pair of vertical four-sided tubular posts being adaptable to be secured to a support surface;

b. a plurality of spaced apart horizontal four-sided tubular rails, each rail extending transversely to and secured between said pair of vertical tubular posts, each rail having a plurality of equally spaced apart four-sided through apertures therein centered on a longitudinal axis of said each rail where the respective apertures of the plurality of horizontal rails are aligned;

c. a plurality of vertically disposed four-sided tubular pickets arranged in mutually parallel relationship between and extending through respectively aligned ones of said plurality of apertures of said plurality of horizontal tubular rails, each picket having at least two locations along the length of said each picket corresponding to a respective two of said plurality of horizontal tubular rails, a respective transverse slotted aperture extending therethrough perpendicularly to the longitudinal axis of the picket;

d. a one-piece flat generally H-shaped locking means having a middle section and two leg sections located on opposite sides of the middle section, a respective H-shaped locking means inserted into said each transverse slotted aperture of said picket such that the middle section is located within an interior of said each transverse slotted aperture of said picket and the two leg sections are extending outside of said each transverse slotted aperture; and e. said plurality of vertically tubular pickets being respectively in said plurality of apertures of said plurality of horizontal tubular rails wherein said plurality of tubular pickets are axially movable in said plurality of apertures of said horizontal rails to a locking position at which said leg sections of said respective H-shaped locking means in said each transverse slotted aperture of said picket engage said respective two of said plurality of horizontal tubular rails and further axial movement of said plurality of tubular pickets relative to said plurality of horizontal tubular rails is prevented.

2. The modular fence assembly in accordance with claim 1, further comprising a plurality of equally spaced apart ornaments between a respective two of said plurality of horizontal tubular rails.

3. The modular fence assembly in accordance with claim 1, further comprising an ornamental cap for each of said plurality of apertures of said plurality of horizontal tubular rails to form a watertight smooth joint between said plurality of tubular pickets and said plurality horizontal tubular rails.

4. The modular fence assembly in accordance with claim 1, wherein said each transverse slotted aperture of said picket is generally rectangular shape.

5. A modular fence assembly, comprising:

a. at least one horizontal lower rail having a plurality of non-circular apertures extending therethrough and centered on a longitudinal axis of said at least one horizontal lower rail;

b. at least one horizontal upper rail having a plurality of non-circular apertures extending therethrough and centered on a longitudinal axis of said at least one horizontal upper rail and respectively aligned with said plurality of apertures of said at least one horizontal upper rail;

c. at least two vertical posts being adaptable to be secured to a support surface, each having means for removably attaching the ends of said at least one horizontal upper and lower rails therebetween;

d. a plurality of vertically disposed pickets arranged in mutually parallel relationship between said at least two vertical posts and extending snugly through respectively aligned ones of said plurality of apertures of said at least one horizontal upper and lower rails;

e. said each picket having a pair of transverse slotted apertures extending therethrough and located along the length of said each picket and respectively corresponding to said at least one horizontal upper and lower rails;

f. a one-piece flat generally H-shaped locking means having a middle section and two leg sections located on opposite sides of the middle section, a respective H-shaped locking means inserted into said each transverse slotted aperture of said picket such that the middle section is located within an interior of said each transverse slotted aperture of said picket and the two leg sections are extending outside of said each transverse slotted aperture of said picket; and g. said plurality of vertically pickets being respectively in said plurality of apertures of said at least one horizontal upper and lower rails wherein said plurality of pickets are axially movable in said plurality of apertures of said horizontal rails to a locking position at which said leg sections of said respective H-shaped locking means in said plurality of pickets engage said at least one horizontal upper and lower rails and axial movement of said plurality of pickets relative to said at least one horizontal upper and lower rails is prevented.

6. The modular fence assembly in accordance with claim 5, further comprising another elongated horizontal rail secured between said at least two posts and located between said at least one upper and lower rails and adjacent to said at least one upper rail, the another horizontal rail having a plurality of apertures aligned with said plurality of apertures of said at least one horizontal upper and lower rails for securing a plurality of ornaments therebetween said at least one upper rail and the another elongated horizontal rail.

7. The modular fence assembly in accordance with claim 6, further comprising an ornamental cap for each of said plurality of apertures on said at least one horizontal upper and lower rails and said another horizontal rail to form a watertight smooth joint between said plurality of pickets and said at least one horizontal upper and lower rails and said another horizontal rail.

8. The modular fence assembly in accordance with claim 5, wherein said each transverse slotted aperture of said picket is generally rectangular shape.

9. The modular fence assembly in accordance with claim 5, wherein said attaching means include brackets.

* * * * *